US006880450B2

(12) United States Patent
Stölzer

(10) Patent No.: US 6,880,450 B2
(45) Date of Patent: Apr. 19, 2005

(54) AXIAL PISTON ENGINE COMPRISING A RETURN DEVICE

(75) Inventor: Rainer Stölzer, Neu-Ulm (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 63 days.

(21) Appl. No.: 10/258,302

(22) PCT Filed: May 16, 2001

(86) PCT No.: PCT/EP01/05592

§ 371 (c)(1),
(2), (4) Date: Oct. 23, 2002

(87) PCT Pub. No.: WO02/08603

PCT Pub. Date: Jan. 31, 2002

(65) Prior Publication Data

US 2003/0094096 A1 May 22, 2003

(51) Int. Cl.[7] ..... F04B 1/12
(52) U.S. Cl. ..... 92/12.2; 92/71; 91/506
(58) Field of Search ..... 92/12.2, 57, 71; 91/505, 506

(56) References Cited

U.S. PATENT DOCUMENTS 4,581,980 A * 4/1986 Berthold ..... 92/12.2
4,690,036 A * 9/1987 Kosaka et al. ..... 92/12.2
5,095,807 A * 3/1992 Wagenseil ..... 92/12.2
5,826,488 A * 10/1998 Arai et al. ..... 92/12.2
6,174,139 B1 * 1/2001 Stolzer ..... 92/12.2

FOREIGN PATENT DOCUMENTS

| | | |
|---|---|---|
| DE | 43 37 065 A1 | 5/1995 |
| DE | 198 00 631 A1 | 7/1999 |
| EP | 0 309 762 A2 | 4/1989 |
| EP | 0 793 018 A1 | 9/1997 |
| EP | 0 921 312 A2 | 6/1999 |
| EP | 0 928 895 A2 | 7/1999 |
| WO | WO 93/10349 | 5/1993 |

* cited by examiner

*Primary Examiner*—Thomas E. Lazo
(74) *Attorney, Agent, or Firm*—Scully, Scott, Murphy & Presser

(57) ABSTRACT

The invention relates to an axial piston engine (1) comprising a housing (2) wherein a cylinder drum (17) is arranged. Several axially extending piston bores (21) are embodied in the cylinder drum and arranged in such a way that they are distributed around the longitudinal center axis (7*a*) of the cylinder drum (17). Pistons (23) are moveably guided in said bores and are supported by sliding shoes (29) on a pivoting mounted on a transversely extending pivoting axis (27). A stop (44*b*) or a stop (44*a*, 44*b*) on both sides of the pivoting axis (27) is/are provided in order to limit the pivoting movements of the pivoting plate (26). In order to stabilize the axial piston engine and provide it with a simple design, the stop (44*b*) or both stops (44*a*, 44*b*) are arranged on a sleeve-like supporting element (45) which is supported by the inner covering surface (3*c*) of the inside of the housing (4).

13 Claims, 3 Drawing Sheets

AXIAL PISTON ENGINE COMPRISING A RETURN DEVICE

Figure 1:
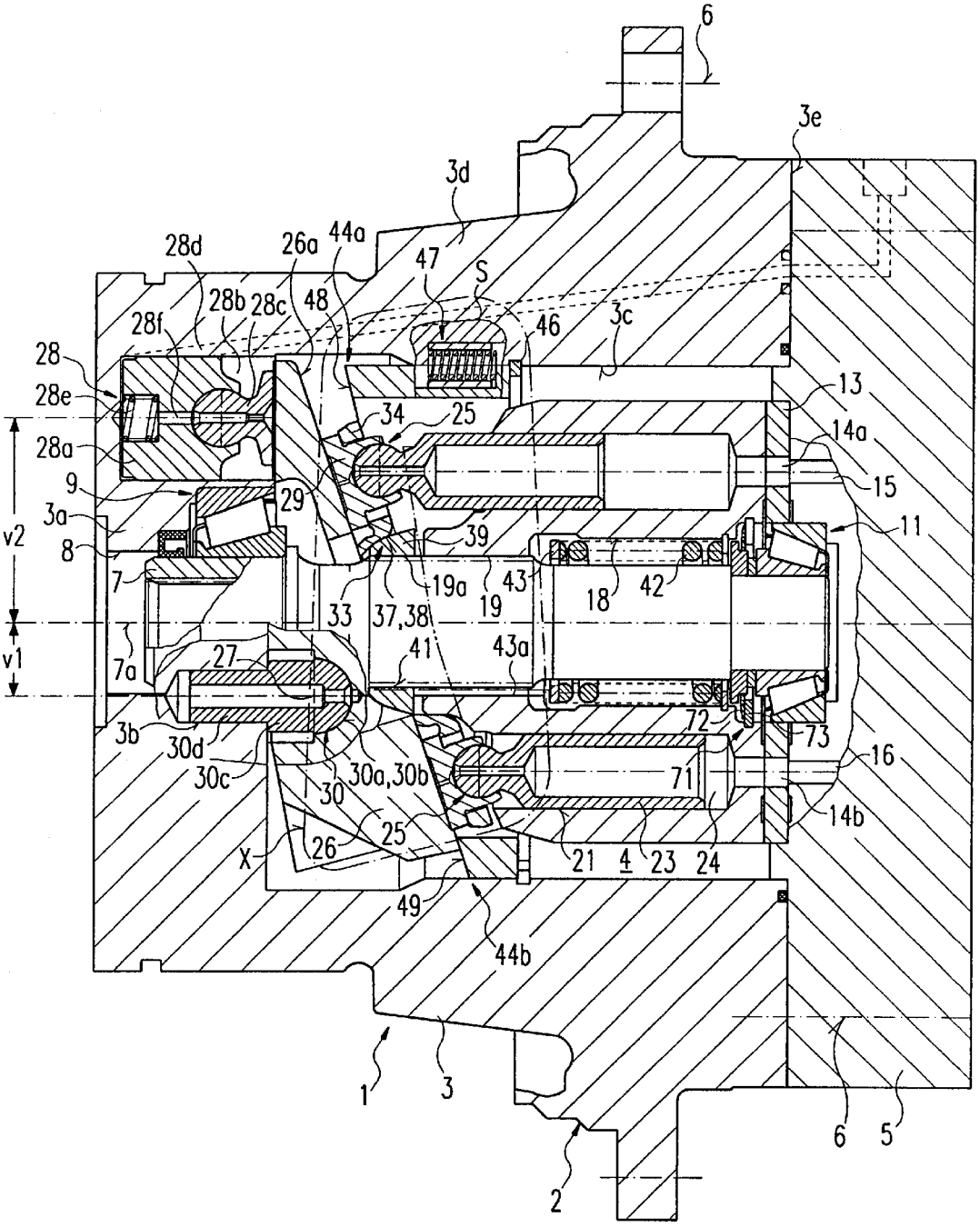

The invention relates to an axial piston engine according to the preamble of claim 1, 5 or 6.

An axial piston engine having a swivel plate capable of swivelling about a swivelling axis is an axial piston engine with a variable throughput rate. Said rate may be adjusted by means of a so-called adjusting apparatus, by means of which the swivel plate may be swivelled and locked in the respective desired swivel position. Said adjusting apparatus may be an apparatus, by means of which the swivel plate is adjustable only between its swivel end positions, i.e. between the minimum and the maximum rate setting, or an adjusting apparatus, by means of which the swivel plate is adjustable and lockable also in intermediate positions between the swivel end positions, wherein the delivery rate is e.g. infinitely adjustable.

Particularly in an axial piston engine of the type, in which only the minimum and the maximum delivery rate are adjustable, considerable locking forces are needed to lock the swivel plate in its swivel position. Said locking forces may admittedly be summoned up by an adjusting element connected to the swivel plate but, for said purpose, a very stable construction of the adjusting element is required. In order to simplify the design, it has already been proposed, particularly in the case of swivel plates having a swivel bearing arrangement in the form of a swivel cradle, to provide mechanical stops for limiting the minimum and maximum swivel end position. Given such limitation of swivelling, the adjusting apparatus is at least relieved of load in the swivel end positions.

An axial piston engine according to the preamble of claim 5 or 6 is described in DE 198 00 631 A1. In said previously known construction, the axial piston engine has a return apparatus, against which the sliding pads are supported during the return motion of the pistons. The axial piston engine moreover has a retaining apparatus formed by at least one supporting part, which axially supports the return apparatus in order to protect it from overload. The supporting part is disposed on the housing, namely in the region of the swivelling axis of the swivel plate at least at the side of the axial piston engine at which the pistons execute an induction stroke, wherein the supporting part forms a stop disposed at a distance from the return apparatus. Because of the axial distance of the stop and/or supporting part from the return apparatus it is guaranteed that during normal operation there is no contact between the supporting part and the return apparatus. It is only when the return apparatus is overloaded and gives axially within its limit of elasticity that said apparatus comes into supportive contact with the supporting part and is axially effectively supported, thereby preventing the return apparatus from being overloaded beyond the limit of elasticity and damaged. The arrangement of the supporting part in the region of the swivelling axis makes it possible for the supporting part, in all swivel positions of the swivel plate, to be situated in relation to the latter in an advantageous contact and support position. The retaining apparatus is therefore suitable for axial piston engines of a variable or invariable throughput rate.

The underlying object of the invention is to stabilize an axial piston engine of the type indicated in the preamble of claim 1 or 5, while guaranteeing a simple construction.

Said object is achieved by the features of claim 1 or 5. Advantageous developments of the invention are described in the associated sub-claims.

In the construction according to the invention according to claim 1, the stops are disposed on the sleeve-shaped supporting part, which is supported against the wall of the housing interior.

In the construction according to the invention according to claim 5, the shoulder is disposed on the sleeve-shaped supporting part, which is supported against the wall of the housing interior.

Both construction are advantageous for several reasons. First of all, the stops and/or the shoulder may be realized in a simple style of construction because they are disposed on a single supporting part and may therefore be manufactured easily, quickly and economically and installed by mounting the supporting part. The construction according to the invention is moreover notable for high built-on stability because the supporting part may be supported easily and by a large surface area against the wall of the housing interior. In said respect, the sleeve-shaped form of the supporting part proves advantageous because the supporting part may be supported positively against the housing and so easy and stable support is achievable. This applies particularly to a supporting part mounted in an axially displaceable manner, which is described in detail further below.

A further underlying object of the invention is to construct an axial piston engine of the type indicated in the preamble of claim 6 in such a way that the distance situation between the return apparatus and the supporting part is improved.

Said object is achieved by the features of claim 6. Advantageous developments of the invention are described in the associated sub-claims.

In the construction according to the invention according to claim 6, the supporting part is mounted in an axially displaceable manner and loadable by the cylinder drum towards a restoring element in such a way that with progressive loading by the cylinder drum the distance between the supporting part and the return apparatus becomes smaller. Thus, in the event of peak loads of the axial piston engine a desirable reduction of the distance between the return apparatus and the retaining apparatus is effected, wherein said reduction is based on the fact that the cylinder drum likewise has a tendency to lift off a cam disk during the induction stroke of the pistons. Said lifting-off motion is a consequence of peak loading and/or overloading of the axial piston engine. The lifting-off motion of the cylinder drum leads, in the construction according to the invention, to a reduction of the distance between the supporting part and the return apparatus so that, in the event of peak loading and/or overloading, because of the reduced distance an effective supporting of the return apparatus is effected. The construction according to the invention therefore provides a means whereby, in the event of peak loading and/or overloading of the axial piston engine, the distance between the supporting part and the return apparatus is reduced, with the result that the supporting of the return apparatus comes into effect earlier and is therefore improved.

The previously described axial distance between the supporting part and the return apparatus may be e.g. around 1 mm. If the distance is too small, there is a risk of the return apparatus and the supporting part coming into mutual contact and of the return apparatus sliding on the supporting part before overloading of the return device occurs. If the distance is too great, there is a risk of the return apparatus being overloaded and damaged, e.g. warped, before the additional support against the supporting part may occur.

Another aspect of the axial piston engine according to the invention is such that the supporting part without a shoulder surface for the return apparatus and without stops for the swivel plate extends up to the cylinder drum and is at a sliding distance from the cylinder drum. In said construction, the supporting part acts as an abutment for the cylinder drum. Said abutment may replace other axial abutments for the cylinder drum or be provided as an additional abutment. The function of an abutment for the cylinder drum is fulfilled also when the supporting part is mounted in an axially displaceable manner. In such a construction, the abutment function is admittedly reduced and limited to the force of the restoring element, but said restoring force too is an abutment force.

The supporting part according to the invention may be developed very advantageously in that it is used both as a stop part for the swivel plate and as a safety retainer for the return apparatus. In said case, a simple and stable construction as a sleeve-shaped component is achievable.

The further sub-claims contain features which, while guaranteeing a stable construction, enable easy and economical manufacture as well as assembly and/or disassembly.

Figure 3:
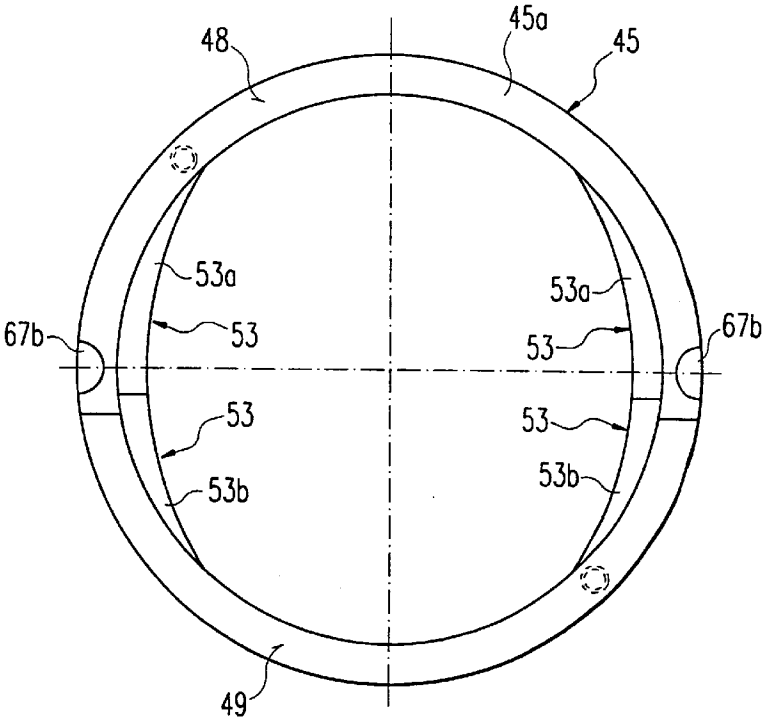
Figure 4:
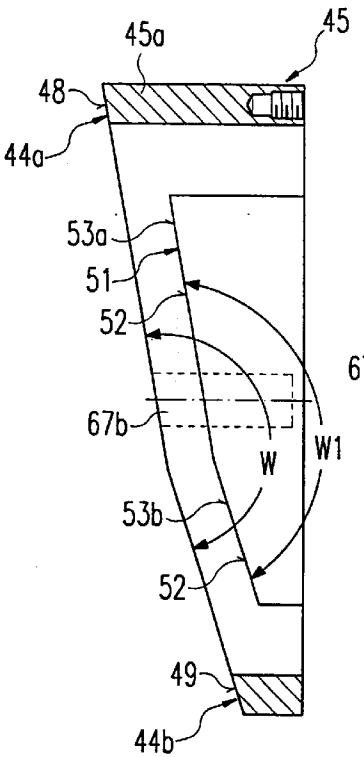
Figure 2:
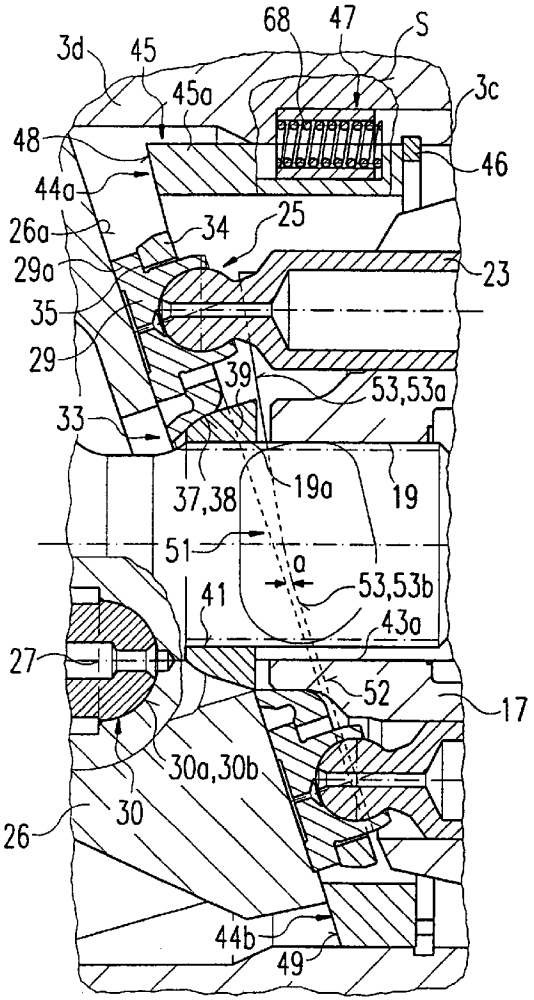

There now follows a detailed description of the invention and further advantages achievable by the invention with reference to advantageous constructions of embodiments and drawings. The drawings show:

FIG. 1 an axial piston engine according to the invention in axial section;

FIG. 2 an enlarged view of the detail denoted by X in FIG. 1;

FIG. 3 a front view from the left of a supporting part in the form of a sleeve of the axial piston engine;

FIG. 4 the supporting part in axial section; and

Figure 5:
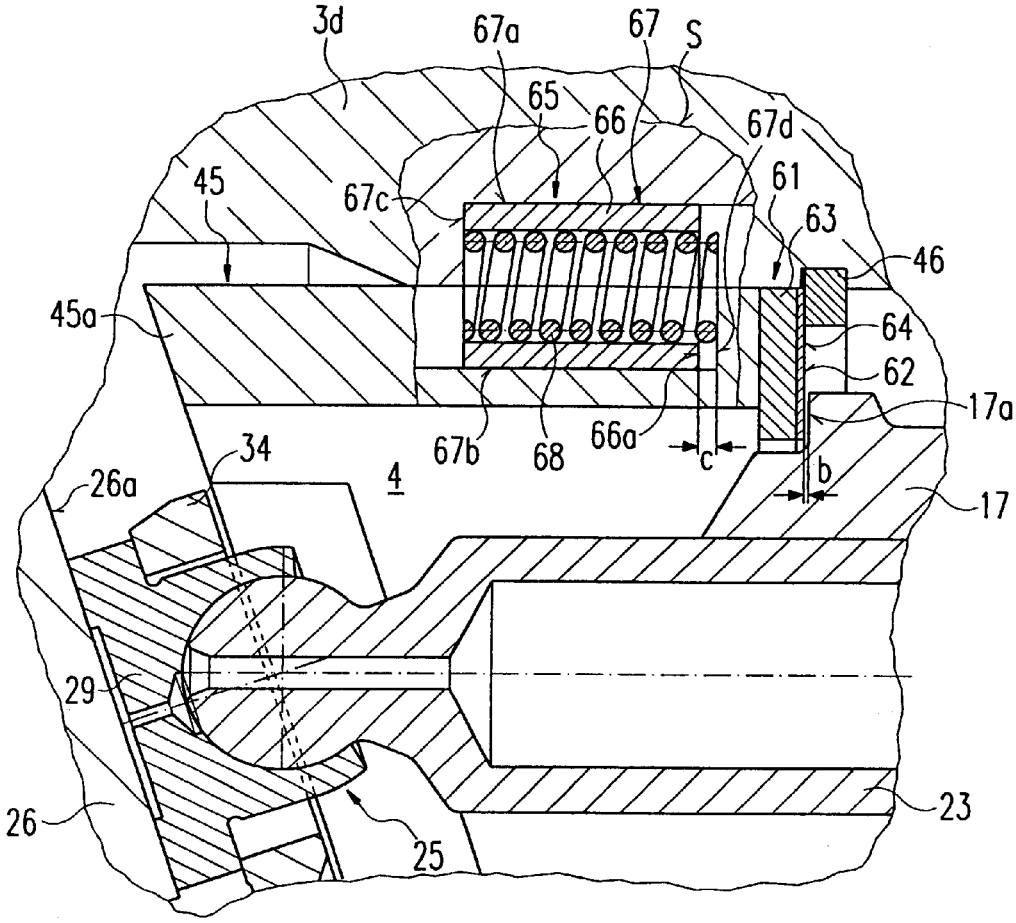

FIG. 5 the detail X in a modified construction.

The axial piston engine 1 illustrated by way of example comprises a closed housing 2 having a pot-shaped housing part 3, the housing interior 4 of which is detachably closed by means of a so-called connecting part 5, which is screw-fastened in the sense of a lid to the free edge of the housing part 3 by screws 6 shown in an implied manner. Mounted rotatably in the housing 2 is a drive shaft 7, which at least partially penetrates the base wall 3*a* of the pot-shaped housing 3 in a bearing hole 8 and is mounted in a freely rotatable manner by means of rolling-contact bearings 9, 11 indirectly or directly on the base wall 3*a* of the pot-shaped housing 3 and on the connecting part 5. Disposed against the inside of the connecting part 5 is a cam disk 13 having control channels 14*a*, 14*b*, which extend diametrically opposite one another approximately parallel to the axis of rotation 7*a* of the drive shaft 7 and are connected respectively to a supply line 15 and a discharge line 16 in the connecting part 5. Lying against the inside of the cam disk 13 is a cylinder drum 17, which is seated by means of a coaxial longitudinal bore 18 on the drive shaft 7 and connected non-rotatably thereto by a multitooth coupling 19, which in the present embodiment is disposed only in an end region of the cylinder drum 17 remote from the cam disk 13 and in a longitudinal region of the drive shaft 7 radially adjacent to said end region.

Disposed in the cylinder drum 17 and distributed around the circumference is a plurality of approximately paraxially extending piston bores 21, which at their ends facing the control channels 14*a*, 14*b* are connected by tapered supply and discharge channels to the control channels 14*a* and 14*b* respectively and which open out at the end of the cylinder drum 17 remote from the cam disk 13. Pistons 23 are mounted so as to be axially displaceable to and fro in the piston bores 21 and with their ends facing the cam disk 13 delimit working chambers 24 in the piston bores 21 and with their head ends remote from the cam disk 13 project from the cylinder drum 17 and are axially supported by means of supporting joints 25, in particular ball joints, in an obliquely extending transverse plane against a swivel plate 26. The swivel plate 26, for increasing or reducing the variable throughput rate, is mounted so as to be capable of swivelling about a swivelling axis 27 extending at right angles to the axis of rotation 7*a* and is adjustable by means of an adjusting apparatus 28 preferably disposed in the housing interior 4 and is lockable in the respective adjusted position. The swivel plate 26 at its side facing the cylinder drum 17 has an inclined surface 26*a*, against which the pistons 23 are supported by means of sliding pads 29, which are connected by the supporting joints 25 in a universally pivotal manner to the preferably spherical head ends of the pistons 23.

The swivel bearing 30 of the swivel plate 26 thus formed is a so-called cradle bearing or closed bearing, which may be fitted by introducing the swivel plate 26 from the direction of the housing opening and in the present embodiment is formed by a concave bearing surface 30*a* on the swivel plate 26 facing the base wall 3*a* and by a matching convex bearing surface 30*b* supported against the base wall 3*a*, which bearing surfaces extend approximately over an angle of about 180°. The swivel plate 26 may therefore be removed from and/or lifted off the swivel bearing 30 in the direction of the housing opening. The base-side bearing surface 30*b* may be formed on one or more bearing parts 30*c*, which is/are inserted by at least one insertion pin 30*d* facing the base wall 3*a* into an insertion hole 3*b* in the base wall 3*a* and is/are therefore positioned in transverse direction and in the direction of the base wall 3*a*.

During functional operation of the axial piston engine 1 the drive shaft 7 and the cylinder drum 17 rotate jointly about the axis of rotation 7*a*, while the pistons 23 are displaced to and fro in the piston bores 21 by the inclined surface 26*a* of the non-rotating swivel plate 26. In said case, the axial piston engine 1 may operate in pump mode or engine mode. In order to prevent the sliding pads 29 from lifting off the inclined surface 26*a* during the induction stroke, there is associated with the sliding pads 29 a return apparatus 33, which keeps the sliding pads 29 in contact with the inclined surface 26*a* and in the present embodiment is formed by a return disk 33, which in a known manner engages with bore edges 35 behind flanges 29*a* of the sliding pads 29. The return disk 34, which preferably extends in a straight manner, is axially supported by a cone-segment-shaped concave bearing surface 37 against a correspondingly cone-segment-shaped convex bearing surface 38 of a supporting ring 39, which is mounted by means of a bearing bore 41 in an axially displaceable manner on the drive shaft 7 and is supported in the direction of the cylinder drum 17. The supporting ring 39 is preferably connected by a second multitooth coupling 19*a* in a non-rotatable manner to the drive shaft 7, wherein the teeth on the drive shaft 7 may be provided jointly for both multitooth couplings 19, 19*a* and be of a corresponding length.

To achieve efficient sealing between the cylinder drum 17 and the cam disk 13, the cylinder drum 17 is biased with an axial elastic force towards the cam disk 13. In the embodiment according to FIG. 1, pressing forces for the sliding pads 29 and the cylinder drum 17 are generated by a common, axially effective spring 42, which may be disposed e.g. between a supporting ring 43 and the cylinder drum 17 and presses the latter towards the cam disk 13. The compression spring 42 in the form of a cylindrical helical spring may act upon the supporting ring 39 by means of pressure pins 43*a*, which are arranged so as to be distributed around the periphery of the drive shaft 7 and are mounted in an axially displaceable manner in feedthrough holes of the cylinder drum 17 and extend from the supporting ring 43 to the supporting ring 39.

For delimiting the minimum and maximum swivel position of the swivel plate 26, one stop 44 or two stops 44*a*, 44*b* is/are disposed on a housing-fixed supporting part 45, which is common to both stops and is supported and held against the housing wall surrounding the housing interior 4. In the present embodiment, the supporting part 45 is formed by a ring and/or a sleeve 45*a*, which abuts the inner lateral surface 3*c* of the peripheral wall 3*d* of the housing 3 and is axially positioned. For said purpose, a spring ring 46 may be used, which is seated in an internal annular groove in the inner lateral surface 3*c* and engages behind a radial end face of the sleeve 45*a*. In the direction of the swivel plate 26 the supporting part 45 is supported by means of a positioning apparatus, which is denoted as a whole by 47 and described in greater detail further below.

The stops 44*a*, 44*b* are formed by inclined stop faces 48, 49 on the end of the supporting part 45 facing the swivel plate 26, the inclination of which stop faces is adapted to the swivel plate 26 in such a way that the inclined surface 26*a* of the latter in the minimum and the maximum swivel end position is in surface contact with the respective inclined stop face 48, 49. In the context of the invention, it is also possible for a different surface of the swivel plate 26 to lie against the stops 44*a*, 44*b*. Preferably, a surface contact is provided so that the surface pressure is reduced. The obtuse angle W included by the stop faces 48, 49 is approximately 180° minus an existing minimum swivel angle and minus the swivel angle of the swivel plate 26 between the swivel end positions.

In the present embodiment, the adjusting apparatus 28 is formed by a hydraulic cylinder disposed paraxially in the base wall 3*a* and having a piston 28*a*, which is mounted so as to be displaceable to and fro in an approximately paraxial piston bore 28*b* and acts with a working member such as a piston rod 28*c* upon the outside of the swivel plate 26. The cylinder is disposed e.g. in relation to the axis of rotation 7*a* at the side of the axial piston engine 1 which is offset in the opposite direction to the radial offset v of the swivelling axis 27 from the axis of rotation 7*a*, see offset dimension v2. Because of the offset arrangement of the swivelling axis 27 and the piston rod 28*c*, an adjustment of the swivel plate 26 by means of the cylinder requires only a translatory motion, which the piston rod 28*c* executes after loading of the adjusting cylinder with an actuating pressure through an actuating pressure line 28*d*, which penetrates the add-on joint 3*e* in a sealed manner and passes with its power connection out of the connecting part 5. In said case, the swivel plate 26 executes a swivelling motion in the direction of a minimum delivery rate, wherein it is limited at the stop 44*a* in the minimum swivel end position. A restoring of the swivel plate 26 in the direction of its maximum swivel end position is effected automatically when the hydraulic loading of the piston 28*a* with the actuating pressure is discontinued. A resulting axial exhaust pressure of the pistons 23 then arises, by means of which the swivel plate 26 is adjusted in the direction of its maximum swivel end position and held in abutment against the piston rod 28*c*. By means of a spring 28*e*, in particular a cylindrical helical spring, which is disposed preferably in a blind hole between the piston 28*a* and a remaining part of the base wall 3*a*, the abutment of the piston rod 28*c* against the swivel plate 26 may be guaranteed also in the non-pressurized state.

The piston rod 28*c* is connected by a supporting joint 25 in an articulated manner to the piston 28*a*. Here too, as already in the case of the articulated connections between the pistons 23 and the sliding pads 29, a ball joint connection is provided, comprising a spherical head, e.g. on the piston rod 28*c*, and an undercut ball socket, e.g. on the piston 28*a*.

In the context of the invention, the hydraulic cylinder may alternatively be designed in such a way that the restoring of the swivel plate 26 into its maximum swivel end position may be effected actively by means of the piston 28*a* or the piston rod 28*c*, which in said case may be connected to the swivel plate 26 in such a way that they may exert a tensile force upon the latter.

If at least one of the two stops 44*a*, 44*b* on the supporting part 45 may be disposed on the housing 2, then only one stop, in particular for the minimum swivel end position, is required on the supporting part 45. In the present embodiment, a stop delimiting the swivel plate 26 in its maximum swivel end position may be formed in a different manner, e.g. by the inner surface of the base wall 3*a*, against which the swivel plate abuts. In such a case, it is possible to dispense with the relevant stop on the supporting part 45, here the stop 44*b*.

As may be seen from FIG. 1, the piston 28*a* has a preferably coaxial channel 28*f*, which extends to the spherical bearing surface of the ball joint connection and leads in the piston rod 28*c* up to the latter's preferably widened free end face, particularly in the region of a channel widening. The actuating pressure may therefore continue into the bed joint of the ball joint and the contact surface of the piston rod 28*c* and generate in each case a relief from pressure.

In order during functional operation of the axial piston engine 1 to prevent overloading of the return apparatus 33 in the event of increased tensile forces at the pistons 23, there is associated with the return apparatus 33 a retaining apparatus 51, which engages behind the return apparatus 33 at a distance a directed towards the cylinder drum 17 and supports the return apparatus in the event of extreme loading or overloading. The distance a is large enough for the return apparatus 33 to strike and be axially supported against at least one stop 52 of the retaining apparatus 51 before the return apparatus 33 is loaded beyond its limit of elasticity. It is thereby guaranteed that during normal functional operation the small distance a of e.g. 0.4 mm to around 1 mm exists between the return apparatus 33 and the retaining apparatus 51 and there is therefore no friction contact between the return apparatus 33 and the retaining apparatus 51. In the event of increased piston tensile forces, the return apparatus 33 may follow the loading forces, wherein it is e.g. axially bent. Overloading and permanent deformation of the return apparatus 33 is however avoided because said apparatus, before it is deformed beyond its limit of elasticity, comes into abutment against the stop 52 of the retaining apparatus 51. This means that, in the event of such extreme axial loading of the return apparatus 33, the latter is effectively supported and protected from overload by the retaining apparatus 51 and may therefore after extreme loading, on account of its elasticity, return to its normal or initial position, in which it is at the distance a from the retaining apparatus 51. In principle, one stop 52 is sufficient, which is disposed at the side of the axial piston engine 1 at which the piston tensile forces arise. In said case, the stop 52 may be disposed so as to be at the distance a from the return apparatus 33, in the case of a swivel plate 26 adjustable also into intermediate positions, in the respective swivel position or, in the case of a swivel plate 26 adjustable only into the swivel end positions, in the swivel end positions. The retaining apparatus 51 comprises, in relation to the centre line or axis of rotation 7*a*, preferably one stop 52 on either side, i.e. two stops 52 disposed opposite one another, so that the retaining apparatus 51 is effective also in the event of a functional reversal (pump mode/engine mode).

In the present embodiment, the retaining apparatus 51 is disposed on the supporting part 45 and formed by one or two mutually opposite internal supporting shoulders 53, of which the surfaces facing the swivel plate 26 are shaped and positioned in such a way that, in the swivel end positions, they are at the distance a from the return apparatus 31, here from the return disk 34. The supporting shoulders 53 preferably have flat shoulder surfaces 53*a*, 53*b* which, viewed in the longitudinal direction of the swivelling axis 27, extend parallel to and at the distance a from the opposite-lying flat end face of the return disk 34 in the swivel end positions. When the return apparatus 33 is extremely loaded or overloaded, it may give in the region of the distance a without damage, wherein it is effectively supported against the shoulder surfaces 53*a*, 53*b* with surface contact and low surface pressure. In the present construction, the shoulders 53 are formed by material projections, which protrude inwards from the sleeve 45*a* and are arranged in a sickle-shaped manner diametrically opposite one another, as is shown in FIG. 3. The obtuse angle W1 included by the shoulder surfaces 53*a*, 53*b* corresponds to the angle W. Since the sickle-shaped material projections extend at right angles to the swivelling axis 27, there are in each case two shoulders 53 lying opposite one another with shoulder surfaces 53*a*, 53*b* for the minimum and for the maximum swivel end position.

When the return apparatus 33 in the event of extreme loading is axially supported by the retaining apparatus 51, the supporting forces effective at the retaining apparatus 51, because of the latter being fastened to and/or supported against the housing 2, are introduced into the housing 2. In the present construction, the spring ring 46 adequately performs said function.

According to FIG. 5, the supporting part 45 may be a load-bearing base part of a second retaining apparatus 61, which with at least one supporting shoulder 62 axially overlaps the cylinder drum 17 at least at the side, at which the pistons 23 execute an induction stroke, and which is at a small distance b from the cylinder drum 17, which distance during normal operation prevents sliding friction between the cylinder drum 17 and the supporting shoulder 62. The supporting shoulder 62 may be disposed directly on the supporting part 45 and/or on the sleeve 45*a* or be formed by a supporting ring 63, which is inserted in a tightly fitting manner between the sleeve 45*a* and the spring ring 46, and projects radially inwards beyond the sleeve wall, wherein it overlaps an e.g. relieved end face portion 17*a* of the cylinder drum 17 at the distance b. Because of the distance b of e.g. likewise approximately 0.4 mm to approximately 1 mm, frictionless rotation of the cylinder drum 17 next to the supporting shoulder 62 is guaranteed during normal functional operation. The cylinder drum 17, if it lifts off the cam disk 13 in the event of already described higher piston tensile forces, is retained by the second retaining apparatus 61 so that it may lift off at most only by the distance b. When the supporting disk 17 abuts against the stop 64 formed by the supporting shoulder 62, there is admittedly friction between the retaining apparatus 61 and the cylinder drum 17 but said functional state exists only provisionally or for a short time during extreme loading. The supporting part 45, because of its e.g. rigid positioning 9 on the housing 2, is able to take up the load transmitted axially from the cylinder drum 17 to the supporting part 45 and transmit it to the housing 2. The supporting shoulder 62 and/or the supporting ring 63 is preferably coated with a strong material at the side facing the cylinder drum 17.

In the embodiments illustrated in the drawings, the supporting part 45 and/or the sleeve 45*a* is mounted so as to be axially displaceable and non-rotatable in peripheral direction. To said end, an axial guide 65 is provided between the peripheral wall 3*d* of the housing 2 and the supporting part 45 and is formed by a paraxial guide journal 66, which is inserted with motional clearance into a guide recess 67. The guide journal 66 may be formed by a cylinder 67, which is fitted into a guide groove 67*a* of a corresponding cross-sectional shape in the inner lateral surface 3*c* of the peripheral wall 3*d* and into a guide groove 67*b* of a corresponding cross-sectional shape in the outer lateral surface of the sleeve 45*a*. Said constructions each also form a positive-action anti-rotational element for the sleeve 45*a* in the housing 2.

In FIGS. 1, 2 and 5 a single positioning apparatus 47 is shown in a position rotated through 90° in peripheral direction, which is clarified by a partial section of the cutting line S. In reality, one or, in particular, two positioning devices 47 arranged rotated through 90° are provided, which is evident from the existence of two guide grooves 67*b* arranged diametrically opposite one another in the sleeve 45*a* in FIG. 3.

To facilitate assembly, the guide grooves 67*a* in the peripheral wall 3*d* may be extended so as to run out to the add-on surface 3*e* of the peripheral wall 3*d*, which is evident from the partial sections in FIGS. 1, 2 and 5. The guide grooves 67*b* in the sleeve 45*a* may be extended so as to run out to the inclined end face facing the swivel plate 26, which is likewise evident from the partial sections in FIGS. 1, 2 and 5.

What is essential in the arrangement according to FIG. 5 is that the length of the guide journal 66 and the positions of the axially mutually opposite end faces 67*c*, 67*d* of the guide grooves 67*a*, 67*b* are positioned in such a way that in the normal functional position of the sleeve 45*a*, in which position the latter lies indirectly or directly against the spring ring 46, there is a distance c between the end face 67*d*, which delimits the guide groove 67*b* in the direction of the cylinder drum 17, and the end face 66*a* of the guide journal 66 facing the cylinder drum 17. The distance c is in particular equal to or greater than the distance b and preferably equal to or greater than the sum of the distances b and a.

The direct (FIG. 2) or indirect (FIG. 5) abutment of the sleeve 45*a* against the spring ring 46 is guaranteed by means of an axially effective spring 68, which biases the sleeve 45*a* towards the spring ring 46. The spring 66 may be disposed in the journal 66 designed as a sleeve and may be formed preferably by a cylindrical helical spring. Said spring is biased towards the end face 67*d* of the guide groove 67*b* adjacent to the spring ring 46.

In the embodiment according to FIG. 5, no stops 44*a*, 44*b* for limiting the swivelling motion of the swivel plate 26 are provided on the supporting part 45. This is evident from the fact that the inclined shoulder surfaces 53*a*, 53*b* are not axially offset relative to the inclined end face of the supporting part 45, as is the case in the embodiment according to FIGS. 2 to 4. In this embodiment other, non-illustrated stops for limiting the swivelling motions are provided.

Because of the axial displaceability of the supporting part 45, in the embodiment according to FIG. 5 it is guaranteed that the cylinder drum 17, as it lifts progressively off the cam disk 13, displaces the supporting part 45 in the direction of the swivel plate 26 counter to the action of the spring 66 and reduces or eliminates the distance a of the retaining apparatus 51. Thus, in the event of high loads of the axial piston engine, the return apparatus 33 is axially supported by the retaining apparatus 51 earlier than in the event of lower loads.

In the axial piston engine 1 the following constructional variants are possible and operational.

When in the embodiment according to FIG. 2 a retaining apparatus for the return apparatus 33 is provided in a conceivable different construction independent of the supporting part 45, it is possible to dispense with the at least one shoulder surface 53*a*, 53*b* on the supporting part 45, wherein the supporting part 45 fulfils the stop function for the swivel plate 26.

When, on the other hand, conceivable different stops independent of the supporting part 45 are provided for limiting the swivelling motion of the swivel plate 26 in its minimum and maximum swivel position, it is possible to dispense with the stops 44*a*, 44*b* on the supporting part 45, wherein only the retaining apparatus 51 need be constructed on the supporting part 45.

In both previously described constructional cases, the supporting part 45 may be a component, which is independent of the conceivable second retaining apparatus 61 and is disposed and supported on the housing 2, as shown in FIG. 2.

In the context of the invention it is also possible to design the supporting part 45 merely as a carrier for the second retaining apparatus 61, wherein stops for limiting the swivelling motion and a return apparatus of different constructions independent of the supporting part 45 may be provided. In said construction also, the supporting part 45 may be mounted in an axially non-displaceable manner on the housing 2 or guided in an axially displaceable manner on the housing 2. The former case results in a fixed axial stop for the cylinder drum 17, when the latter lifts off. The latter case results in an axially elastically flexible stop when the cylinder drum 17 lifts off.

When the first retaining apparatus 51 and the second retaining apparatus 61 are disposed jointly on the supporting part 45, upon lifting-off of the cylinder drum 17 the described reduction of the distance a of the first retaining apparatus 51 arises.

As may be seen from FIG. 1, a further retaining apparatus 71 acting between the cylinder drum 17 and the drive shaft 7 may be provided, which is effective indirectly between the drive shaft 7 and the cylinder drum 17 and counteracts a lifting-off of the cylinder drum 17. Said further retaining apparatus 71 is formed by an axially effective cup spring 72, which is supported axially against the drive shaft 7 or a built-on part of the latter and overlaps a spring ring 73, which is seated in an internal annular groove of the cylinder drum 17. The dimensions of the associated parts are such that, in the functional position of the cylinder drum 17 in abutment against the cam disk 13, the cup spring 72 indirectly via the spring ring 73 biases the cylinder drum 17 towards the cam disk 13 or limits the cylinder drum. The cup spring 72 may moreover be bent elastically in the direction of the swivel plate 26. Said restoring force is set high enough to allow the cylinder drum 17, in the event of high piston suction forces or related overloads, to lift off axially from the cam disk 13. If the lifting-off motion exceeds the dimension b, the supporting part 45 is displaced in the direction of the inclined surface 26*a*, and the prescribed distance a is reduced. The axial force of the at least one spring 68 is preferably set lower than the axial force of the cup spring 72.

What is claimed is:

1. Axial piston engine (1) having a housing (2), in the housing interior (4) of which a cylinder drum (17) is mounted, in which a plurality of approximately axially extending piston bores (21) are formed, which are arranged so as to be distributed around the longitudinal centre line (7*a*) of the cylinder drum (17) and in which pistons (23) are movably guided, which are supported via sliding pads (29) against a swivel plate (26) mounted so as to be capable of swivelling about a transversely extending swivelling axis (27), wherein one stop (44*b*) or one stop (44*a*, 44*b*) disposed on either side of the swivelling axis (27) is or are provided for limiting the swivelling motions of the swivel plate (26), characterized in that the stop (44*b*) or both stops (44*a*, 44*b*) are disposed on a sleeve-shaped supporting part (45), which is supported against the inner lateral surface (3*c*) of the housing interior (4).

2. Axial piston engine according to claim 1, characterized in that the stop or stops (44*a*, 44*b*) are formed by stop faces (48, 49), with which the swivel plate (26) is in surface contact, preferably by means of an inclined surface (26*a*), against which the sliding pads (29) are supported.

3. Axial piston engine according to claim 1 or 2, characterized in that the stop face or stop faces (48, 49) are disposed on the end face of the supporting part (45) facing the swivel plate (26).

4. Axial piston engine according to one of the preceding claims, characterized in that a return apparatus (33) is provided, against which the sliding pads (29) are supported during the return motion of the pistons (23), and on the supporting part (45) a retaining apparatus (51) is disposed, which engages at an axial distance (a) behind the return apparatus (33) at the side remote from the swivel plate (26).

5. Axial piston engine (1) having a housing (2), in the housing interior (4) of which a cylinder drum (17) is mounted, in which a plurality of approximately axially extending piston bores (21) are formed, which are arranged so as to be distributed around the longitudinal centre line (7*a*) of the cylinder drum (17) and in which pistons (23) are movably guided, which are supported via sliding pads (29) against an inclined surface (26*a*) of a swivel plate (26), and having disposed on the housing (2) a first retaining apparatus (51) with a supporting part (45) with a shoulder (53) for supporting a return apparatus (33) against the housing (2), wherein the shoulder (53) is disposed at the side of the axial piston engine (1) at which the pistons (23) execute an induction stroke, and wherein the shoulder (53) engages at an axial distance (a) behind the return apparatus (33) at the side facing the cylinder drum (17), characterized in that the shoulder (53) is disposed on a sleeve-shaped supporting part (45), which is supported against the inner lateral surface (3*c*) of the housing interior (4).

6. Axial piston engine (1) having a housing (2), in the housing interior (4) of which a cylinder drum (17) is mounted, in which a plurality of approximately axially extending piston bores (21) are formed, which are arranged so as to be distributed around the longitudinal centre line (7*a*) of the cylinder drum (17) and in which pistons (23) are movably guided, which are supported via sliding pads (29) against an inclined surface (26*a*) of a swivel plate (26), and having disposed on the housing (2) a first retaining apparatus (51) with a supporting part (45) with a shoulder surface (53*a*, 53*b*) for supporting a return apparatus (33) against the housing (2), wherein the shoulder surface (53*a*, 53*b*) is disposed at the side of the axial piston engine (1) at which the pistons (23) execute an induction stroke, and wherein the shoulder surface (53*a*, 53*b*) engages at an axial distance (a) behind the return apparatus (33) at the side facing the cylinder drum (17), characterized in that the supporting part (45) is mounted in an axially displaceable manner and is loadable by the cylinder drum (17) towards a restoring element in such a way that with progressive loading by the cylinder drum (17) the distance (a) becomes smaller.

7. Axial piston engine according to claim 6, characterized in that the supporting part (45) is a sleeve-shaped component, which is mounted in an axially displaceable manner on the inner wall of the housing (2).

8. Axial piston engine according to claim 6 or 7, characterized in that the supporting part (45) overlaps the cylinder drum (17) at an axial distance (b) at the side facing the swivel plate (26).

9. Axial piston engine according to one of claims 5 to 8, characterized in that the retaining apparatus (51) comprises two shoulders (53), which are disposed in relation to the swivelling axis (27) on either side of the axial piston engine (1) and are directed towards the swivel plate (26) and, given the provision of one or two stop faces (48, 49), are offset relative to the latter axially in the direction of the cylinder drum (17) and radially inwards.

10. Axial piston engine according to one of claims 5 to 9, characterized in that the shoulder (53) or the shoulders (53) is or are formed in each case by a shoulder surface (53*a*, 53*b*).

11. Axial piston engine according to claim 10, characterized in that mutually associated stop faces and shoulder surfaces (48, 49, 53*a*, 53*b*) extend in each case parallel to one another.

12. Axial piston engine according to one of claims 5 to 11, characterized in that the shoulder (53) or the shoulders (53) or the shoulder surface (53*a*, 53*b*) or the shoulder surfaces (53*a*, 53*b*) is or are disposed in each case on a material projection protruding radially inwards from the sleeve-shaped supporting part (45).

13. Axial piston engine according to one of the preceding claims, characterized in that the supporting part (45) is supported by an end face remote from the swivel plate (26) against a supporting shoulder (46) on the housing (2) and is held by rigidly or flexibly acting means against the supporting shoulder (46), which is preferably formed by a spring ring (46).

* * * * *